US009964300B2

(12) United States Patent
Liu

(10) Patent No.: US 9,964,300 B2
(45) Date of Patent: May 8, 2018

(54) ATOMIZER, ELECTRONIC CIGARETTE, AND METHOD FOR ASSEMBLING THE ATOMIZER

(71) Applicant: HUIZHOU KIMREE TECHNOLOGY CO., LTD. SHENZHEN BRANCH, Shenzhen, Guangdong (CN)

(72) Inventor: Qiuming Liu, Shenzhen (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 738 days.

(21) Appl. No.: 14/460,106

(22) Filed: Aug. 14, 2014

(65) Prior Publication Data

US 2015/0184846 A1 Jul. 2, 2015

(30) Foreign Application Priority Data

Dec. 26, 2013 (WO) ..... PCT/CN2013/090595

(51) Int. Cl.
*A24F 47/00* (2006.01)
*F22B 1/28* (2006.01)

(52) U.S. Cl.
CPC ..... *F22B 1/284* (2013.01); *A24F 47/008* (2013.01)

(58) Field of Classification Search
CPC ... A24F 47/008; A61M 11/042; A61M 15/06; F22B 1/284; H05B 3/06
See application file for complete search history.

(56) References Cited

U.S. PATENT DOCUMENTS

2011/0303231 A1* 12/2011 Li ..... A24F 47/008 131/329
2013/0180533 A1* 7/2013 Kim ..... A24F 47/008 131/273

(Continued)

FOREIGN PATENT DOCUMENTS

CN 201830900 U 5/2011
CN 202077578 U * 12/2011

(Continued)

OTHER PUBLICATIONS

International Written Opinion for PCT-CN2013-090595 dated Jun. 28, 2016.*

(Continued)

*Primary Examiner* — Michael J Felton
*Assistant Examiner* — Jerzi H Moreno Hernandez

(57) ABSTRACT

An atomizer, electronic cigarette and method for assembling the atomizer, wherein the atomizer is configured to be connected to a battery sleeve to form an electronic cigarette, comprising an oil storage cavity, a holding cavity, a heating assembly received in the holding cavity, and an electrode assembly configured to be electrically connected to the battery rod; the heating assembly including a heating wire electrically connected to the electrode assembly and an oil guide rope for transferring tobacco tar to the heating wire; one side of the oil storage cavity defines an oil outlet, a clamp seat configured to clamp the oil guide rope is received in the holding cavity and is located between the heating wire and the oil outlet, and the oil guide rope extends to one side of the clamp seat away from the heating wire.

9 Claims, 7 Drawing Sheets

(56) References Cited

U.S. PATENT DOCUMENTS

2013/0319436 A1 12/2013 Liu
2014/0109898 A1* 4/2014 Li ..... A61M 15/06 128/200.14
2014/0109921 A1* 4/2014 Chen ..... A24F 47/008 131/273
2014/0123989 A1* 5/2014 LaMothe ..... A24F 47/008 131/328
2014/0190477 A1* 7/2014 Qiu ..... A61M 11/042 128/202.21
2014/0360514 A1* 12/2014 Zhu ..... A24F 47/008 131/329
2015/0027471 A1* 1/2015 Feldman ..... H05B 3/16 131/329
2015/0034104 A1* 2/2015 Zhou ..... A24F 47/008 131/329
2015/0059787 A1* 3/2015 Qiu ..... H05B 3/14 131/329
2015/0164146 A1* 6/2015 Li ..... A24F 47/008 131/329

FOREIGN PATENT DOCUMENTS

CN 102894485 A 1/2013
CN 202932040 U 5/2013
CN 203028119 U 7/2013
WO WO 2013/126777 A2 8/2013

OTHER PUBLICATIONS

International Search Report and Written Opinion for International Application No. PCT/CN2013/090595 dated Sep. 29, 2014.

* cited by examiner

ATOMIZER, ELECTRONIC CIGARETTE, AND METHOD FOR ASSEMBLING THE ATOMIZER

CROSS REFERENCE TO RELATED APPLICATIONS

This application claims priority to International Application No. PCT/CN2013/090595, filed Dec. 26, 2013, which is hereby incorporated herein in its entirety by reference.

FIELD OF THE INVENTION

The present invention relates to the field of substitutes for cigarettes, and more particularly, relates to an atomizer, an electronic cigarette, and a method for assembling the atomizer.

BACKGROUND OF THE INVENTION

An electronic cigarette generally uses a battery mounted inside a battery rod to supply power for a heating assembly and generate heat, and thereby causes tobacco tar in an atomizer to be atomized and generates smoke. The smoke is inhaled by users, and thus the electronic cigarette can be used to quit smoking and substitute cigarettes. Therefore, two electrode connectors of the heating assembly need to be electrically connected to a positive pole and a negative pole of the battery respectively, and the tobacco tar in an oil storage cavity needs to be exported by an oil guide rope of the heating assembly, so that a heating wire of the heating assembly can atomize the tobacco tar.

As shown in FIG. 1, a conventional atomizer includes an oil storage cavity 100, and a first electrode connector 101 and a second electrode connector 102 which are electrically connected to a positive pole and a negative pole of a battery respectively. The first electrode connector 101 and the second electrode connector 102 are connected to two ends of the heating wire 103 respectively, and extend to two sides of the heating wire 103 respectively. Specifically, the first electrode connector 101 is welded to a first electrode 105, and the second electrode connector 102, which extends along a direction that is opposite to the extending direction of the first electrode connector 101, is tack welded to a fixing element 17 that abuts against and is electrically connected to a second electrode 106, so that the second electrode connector 102 is electrically connected to the second electrode 106. The heating wire 103 is located in a smoke flow channel 108 of the atomizer, the oil storage cavity 100 defines an oil outlet (not labeled), an oil guide rope 109 running through the oil outlet and extending into the oil storage cavity 100 is sheathed on the heating wire 103, and the oil outlet is aligned with the heating wire 103.

As detailed above, the first electrode connector 101 and the second electrode connector 102 are respectively electrically connected to the first electrode 105 and the second electrode 106 by the welding way, and the connection operations are complex. Thus, an internal structure of the atomizer is complex and is difficult to assemble. Moreover, the tobacco tar flowing from the oil guide rope 109 to the heating wire 103 cannot be controlled, and therefore excessive tobacco tar may flow to the heating wire 103. However, the heating wire 103 may be unable to atomize the excessive tobacco tar in time, and the tobacco tar may flow into the smoke flow channel 108. Furthermore, the tobacco tar in the oil outlet is prone to leak into the smoke flow channel 108, and the tobacco tar may further flow outside the smoke flow channel 108. Thus, oil leakage phenomenon may occur, and the smokers may inhale the tobacco tar.

SUMMARY OF THE INVENTION

The objective of the present invention is to provide an atomizer, an electronic cigarette, and a method for assembling the atomizer, which can avoid oil leakages near a heating wire, aiming at the drawback in the prior art that oil leakages are prone to occur near the heating wire of the atomizer.

The technical solutions of the present invention for solving the technical problems are as follows:

An atomizer configured to be connected to a battery rod to form an electronic cigarette, comprising: an oil storage cavity, a holding cavity, a heating assembly received in the holding cavity, and an electrode assembly configured to be electrically connected to the battery rod; the heating assembly including a heating wire electrically connected to the electrode assembly and an oil guide rope for transferring tobacco tar to the heating wire; wherein one side of the oil storage cavity defines an oil outlet, a clamp seat configured to clamp the oil guide rope is received in the holding cavity and is located between the heating wire and the oil outlet, and the oil guide rope extends to one side of the clamp seat away from the heating wire.

Advantageously, a side surface of the clamp seat defines a first through groove and a second through groove configured to enable two ends of the oil guide rope to go through respectively, and the oil guide rope abuts against a cavity wall of the holding cavity, a first groove wall of the first through groove, and a second groove wall of the second through groove respectively.

Advantageously, the heating assembly further includes a first electrode connector and a second electrode connector connected with two ends of the heating wire respectively and both electrically connected to the electrode assembly, the clamp seat is fixed on the electrode assembly, and at least one of the first electrode connector and the second electrode connector is fixed between the electrode assembly and the clamp seat by clamping.

Advantageously, the electrode assembly includes a first electrode and a second electrode electrically insulated from each other, the first electrode extends into the holding cavity, the clamp seat is sheathed on one end of the first electrode, one end of the first electrode connector away from the heating wire is sandwiched between the clamp seat and the first electrode to form electrical connection between the first electrode connector and the first electrode.

Advantageously, a supporter is sheathed outside the clamp seat, the supporter defines a radially penetrated mounting hole, and the heating wire runs through the mounting hole to be fixed on the supporter.

Advantageously, the clamp seat includes a hollow cylindrical body and a boss formed by increasing a diameter of one end of the body, one end of the body near the first electrode defines a connector hole, one end of the first electrode is inserted in the connector hole, the boss abuts against the cavity wall of the holding cavity, the oil guide rope is sandwiched between the boss and the cavity wall of the holding cavity, and one end of the supporter abuts against one end surface of the boss near the body.

Advantageously, the cavity wall of the holding cavity is made of conducting material and is electrically connected to the second electrode, and the second electrode connector is sandwiched between the cavity wall of the holding cavity and the clamp seat to form electrical connection with the second electrode.

Advantageously, the atomizer further comprises a fastener sheathed outside the supporter and electrically connected to the second electrode, the fastener is hollow and cylindrical, an inner wall of the fastener forms the holding cavity and serves as the cavity wall of the holding cavity, and the first electrode, the clamp seat and the supporter are successively sheathed in the fastener from inside to outside.

Advantageously, the first through groove and the second through groove are defined in the boss and are symmetrical relative to a central axis of the boss, and the first electrode connector extends along a lateral wall of the supporter axially, runs through the first through groove, is bent inward the connector hole, and is sandwiched between an inner wall of the connector hole and an outer wall of the first electrode.

Advantageously, an end surface of the boss away from the body defines an opening slot communicating with the first through groove, and the first electrode connector runs through the first through groove and the opening slot successively, extends along the inner wall of the connector hole axially, and is sandwiched between the inner wall of the connector hole and the outer wall of the first electrode.

Advantageously, one end of the second electrode connector away from the heating wire is bent to be U-shaped, and is sandwiched between the second through groove and the fastener.

Advantageously, the end surface of the boss near the body defines a blind hole, the blind hole is located on one side of the boss near the second through groove, one end of the second electrode connector away from the heating wire runs through the blind hole and is bent to be sandwiched between the clamp seat and the fastener.

Advantageously, the oil guide rope is U-shaped, the oil guide rope includes a straight segment configured to be winded by the heating wire, and a first bent segment and a second bent segment formed on two ends of the straight segment respectively and extending toward the same side; and the first bent segment and the second bent segment are squeezed to be fixed inside the first through groove and the second through groove respectively.

Advantageously, the atomizer further comprises an oil storage component sheathed outside the fastener, the oil storage cavity is formed between an inner wall of the oil storage component and an outer wall of the fastener, the second electrode is embedded inside one end of the oil storage component away from the heating wire to seal the oil storage cavity, and the fastener is inserted in the second electrode and is electrically connected to the second electrode.

Advantageously, the oil outlet is defined in a side wall of the fastener near the second electrode, and tobacco tar in the oil storage cavity flows onto the oil guide rope via the oil outlet.

An electronic cigarette is also provides in the present invention, comprising an atomizer and a battery rod which are interconnected, the atomizer comprising an oil storage cavity, a holding cavity, a heating assembly received in the holding cavity, and an electrode assembly configured to be electrically connected to the battery rod; the heating assembly including a heating wire electrically connected to the electrode assembly and an oil guide rope for transferring tobacco tar to the heating wire; wherein one side of the oil storage cavity defines an oil outlet, a clamp seat configured to clamp the oil guide rope is received in the holding cavity and is located between the heating wire and the oil outlet, and the oil guide rope extends to one side of the clamp seat away from the heating wire.

Advantageously, a side surface of the clamp seat defines a first through groove and a second through groove configured to enable two ends of the oil guide rope to go through respectively, and the oil guide rope abuts against a cavity wall of the holding cavity, a first groove wall of the first through groove, and a second groove wall of the second through groove respectively.

Advantageously, the heating assembly further includes a first electrode connector and a second electrode connector connected with two ends of the heating wire respectively and both electrically connected to the electrode assembly, the clamp seat is fixed on the electrode assembly, and at least one of the first electrode connector and the second electrode connector is fixed between the electrode assembly and the clamp seat by clamping.

Advantageously, the electrode assembly includes a first electrode and a second electrode electrically insulated from each other, the first electrode extends into the holding cavity, the clamp seat is sheathed on one end of the first electrode, one end of the first electrode connector away from the heating wire is sandwiched between the clamp seat and the first electrode to form electrical connection between the first electrode connector and the first electrode.

In one aspect, a method for assembling the atomizer is provided in the present invention, the method comprise the following steps:

S1: inserting the heating assembly, the clamp seat, and the electrode assembly into the holding cavity;

S2: locating the clamp seat configured to clamp the oil guide rope between the heating wire and the oil outlet.

By implementing the atomizer, the electronic cigarette, and the method for assembling the atomizer of the present application, the following advantages can be achieved: the first electrode connector and the second electrode connector are respectively electrically connected to the first electrode and the second electrode by the clamping method. Compared with the welding method in the prior art, the clamping method for fixing is simple in process, easy to assemble, and more reliable in connection, and can improve the working efficiency and easily achieve automatic production.

Moreover, the oil outlet of the oil storage cavity is defined in an end of the oil storage cavity that is away from the heating wire, and a clamp seat is received in the holding cavity and is located between the heating wire and the oil outlet. The clamp seat is configured to clamp the oil guide rope, so that the tobacco tar inside the oil guide rope is mainly congregated in an area near one side of the clamp seat that is away from the heating wire. In this way, the amount of the tobacco tar on the heating wire is appropriate and the heating wire can atomize the tobacco tar in time, which avoids the case that excessive tobacco tar on the heating wire cannot be atomized in time and may flow into the holding cavity to form oil leakage. The smokers will not inhale the tobacco tar, and thus the users' experience is improved.

BRIEF DESCRIPTION OF THE DRAWINGS

The present invention will be further described with reference to the accompanying drawings and embodiments in the following, in the accompanying drawings.

DETAILED DESCRIPTION OF THE PREFERRED EMBODIMENT

In the prior art, the two electrode connectors connected with two ends of the heating wire are respectively electrically connected to the first electrode and the second electrode by the welding method, which may result in complex structures and complicated assembly. Moreover, the heating wire may be unable to atomize tobacco tar in time, and thus oil leakage of the atomizer may occur. To solve the above-mentioned problems, the innovative point of the present invention is that: a clamp seat is added into the atomizer, then one electrode connector is sandwiched between the clamp seat and the first electrode to form an electrical connection with the first electrode, the other electrode connector is sandwiched between the clamp seat and the fastener which has conductive performance to form an electrical connection with the second electrode, and the heating wire is clamped on a sidewall of the clamp seat to prevent excessive tobacco tar from flowing into the heating wire. Compare with the prior art, the clamping connection method replaces the welding connection method. The clamping method is simple to assemble and more reliable in connection, and can easily achieve automatic production. Furthermore, the oil guide rope is clamped on the clamp seat to prevent excessive transportation of tobacco tar, and the oil leakage is thereby avoided.

To make the technical feature, objective and effect of the present invention be understood more clearly, now the specific implementation of the present invention is described in detail with reference to the accompanying drawings and embodiments.

Figure 1:
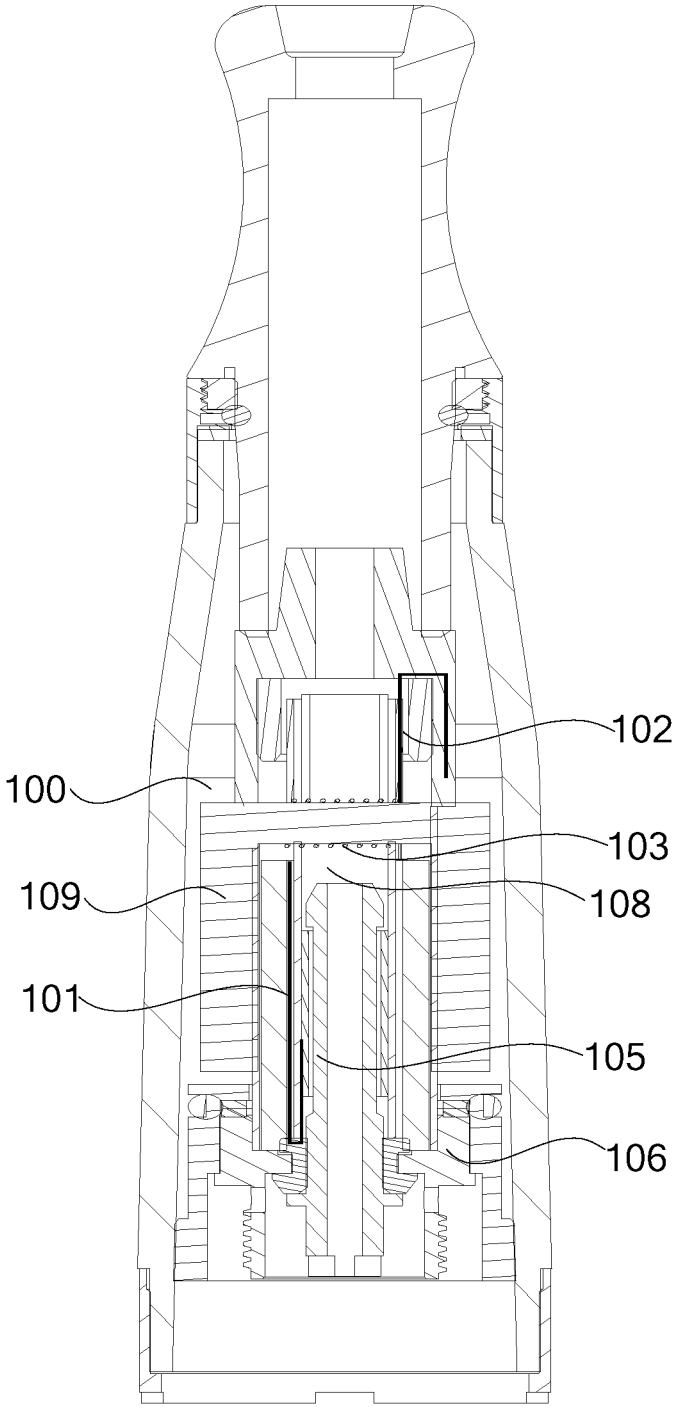
Fig. 1 (Prior Art)
FIG. 1 is a cut-away view of an atomizer in the prior art.
Figure 2:
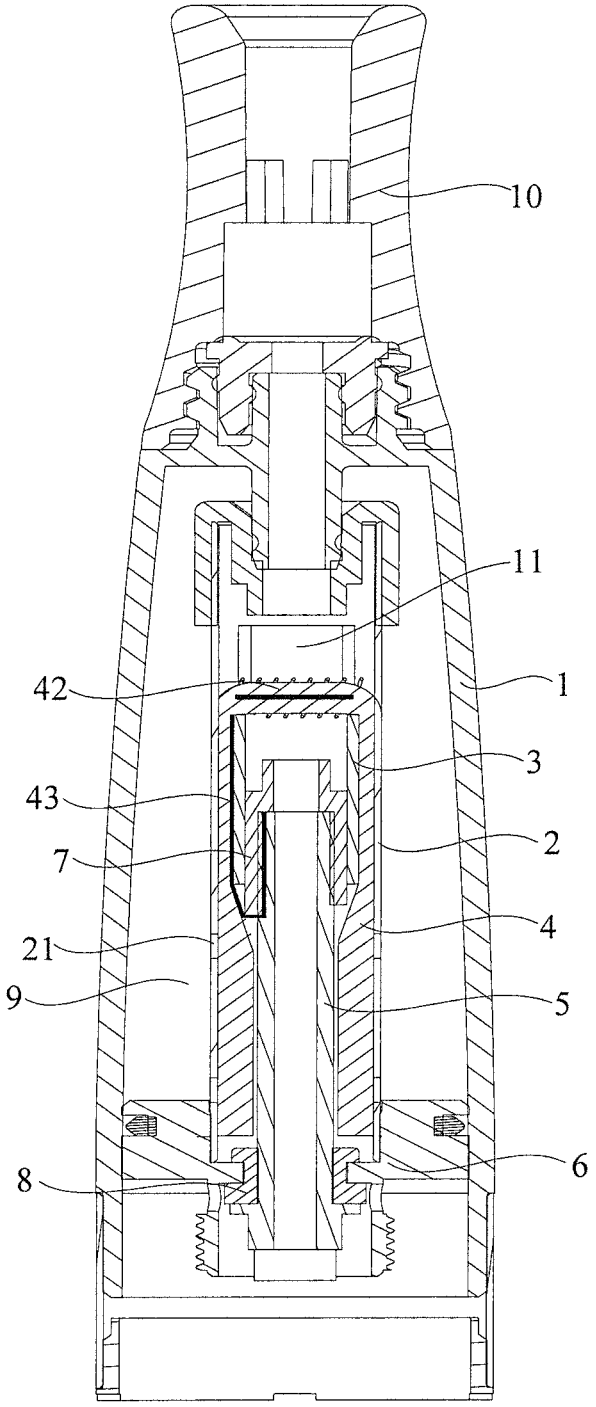
FIG. 2 is a first cut-away view of an atomizer of a preferred embodiment of the present application.
Figure 3:
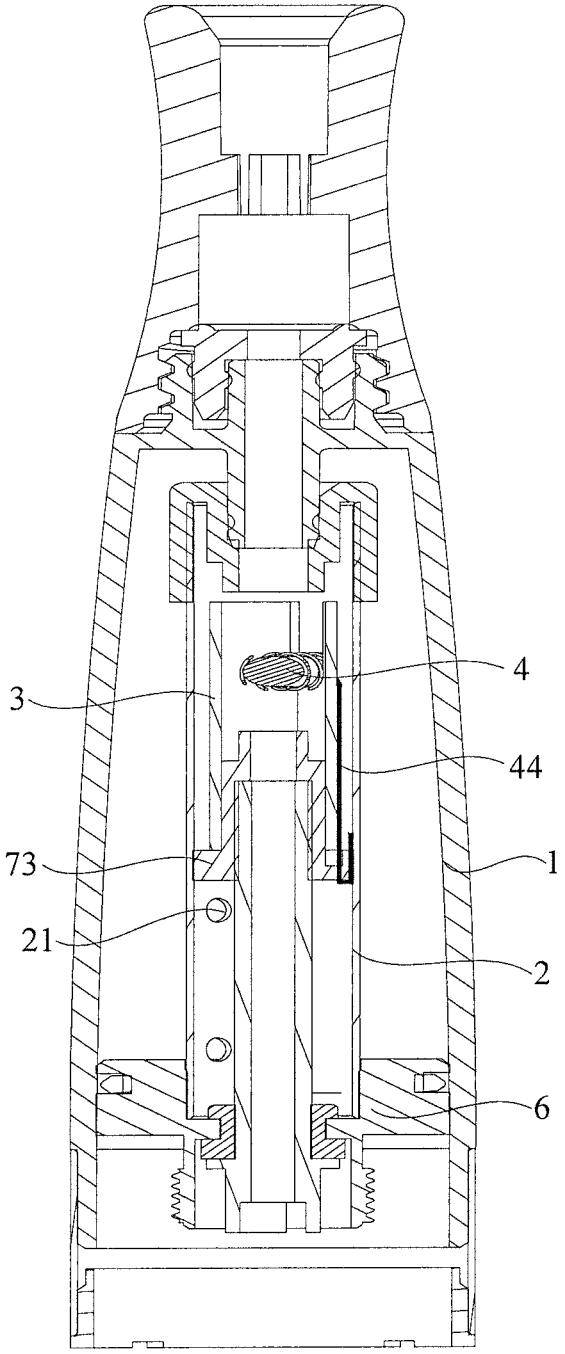
FIG. 3 is a second cut-away view of the atomizer of the preferred embodiment of the present application.
Figure 4:
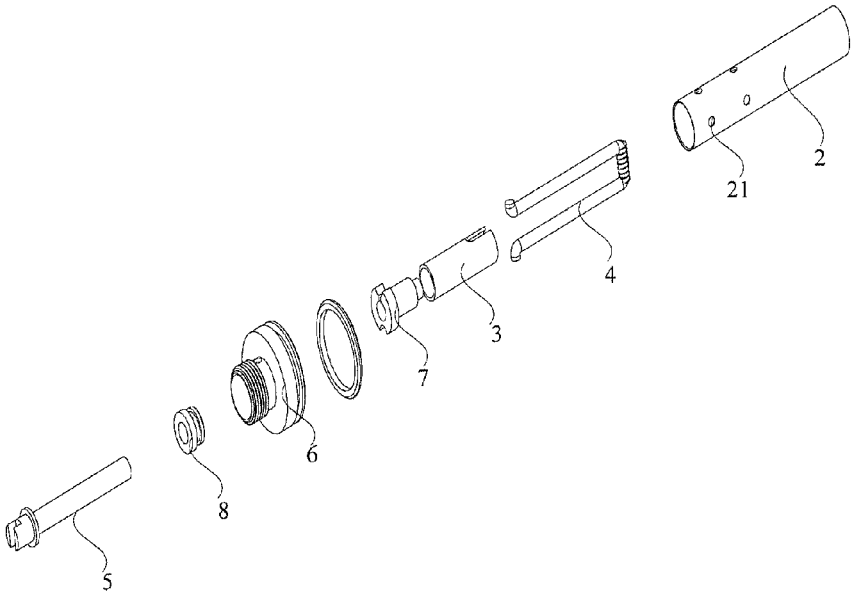
FIG. 4 is an exploded schematic view of a part of the atomizer of the preferred embodiment of the present application.

As shown in FIG. 2, FIG. 3 and FIG. 4, a preferred embodiment of the present invention provides an atomizer configured to be connected with a battery rod to form an electronic cigarette. The atomizer comprises an oil storage component 1 for storing tobacco tar, a fastener 2, a supporter 3, a heating assembly 4, an electrode assembly, a clamp seat 7, an insulating ring 8, an oil storage cavity 9, a nozzle 10, and a holding cavity 11. Wherein the fastener 2, the supporter 3, the heating assembly 4, the electrode assembly, the clamp seat 7, the insulating ring 8, the oil storage cavity 9, and the holding cavity 11 are all sleeved in the oil storage component 1.

The oil storage component 1 and the nozzle 10 are connected to each other; in this embodiment, the oil storage component 1 is detachably connected to the nozzle 10. The nozzle 10 can be shaped as a ring, an arc, a cone, or other shapes, the texture and shape of the nozzle 10 are accommodated with smokers' mouths, and the nozzle 10 is made of soft material or wood material. The oil storage component 1 is hollow and cylindrical, one end of the oil storage component 1 is detachably connected to the nozzle 10, and the other end of the oil storage component 1 is sealed by the electrode assembly.

Figure 5:
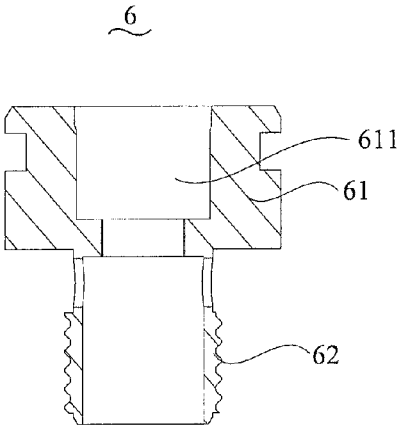
FIG. 5 is a structural schematic view of a second electrode of the atomizer of the preferred embodiment of the present application.

As shown in FIG. 5, the electrode assembly is configured to be electrically connected with the battery rod, specifically, the electrode assembly includes a first electrode 5 and a second electrode 6 electrically insulated from each other. When the atomizer is connected with the battery rod, the first electrode 5 and the second electrode 6 are respectively electrically connected to a positive pole and a negative pole of a battery in the battery rod to power the heating assembly 4.

The second electrode 6 is substantially a hollow cylinder, and includes a buckle portion 61 and a connection portion 62. The buckle portion 61 is a circular ring, and is embedded in one end of the oil storage component 1 away from the nozzle 10 to seal the oil storage component 1. The buckle portion 61 defines a groove 611 configured to fix the fastener 2, and one end of the fastener 2 away from the nozzle 10 is inserted in the groove 611 to abut against and be fixed on a sidewall of the groove 611, thereby enhancing the stability of the fastener 2. The connection portion 62 is formed by reducing a diameter of an end surface of the buckle portion 61 away from the fastener 2, and the connection portion 62 is configured to be connected with the battery rod to form the electronic cigarette. In this embodiment, the connection portion 62 defines an outer thread, and the connection portion 62 forms a threaded connection with the battery rod. The first electrode 5 is substantially a hollow cylinder axially extending into the holding cavity 11 along the atomizer.

The insulating ring 8 is located between the first electrode 5 and the second electrode 6, and is configured to electrically insulate the first electrode 5 from the second electrode 6. The insulating ring 8 is made of insulation material such as resin or rubber, so that the first electrode 5 is electrically insulated from the second electrode 6.

The holding cavity 11 is received in the oil storage component 1, and is configured to receive the heating assembly 4. The first electrode 5, the clamp seat 7, and the supporter 3 are all received in the holding cavity 11. The holding cavity 11 includes a cavity wall (not labeled), and the cavity wall of the holding cavity 11 is made of metal conducting material and is electrically connected to the second electrode 6.

The fastener 2 is shaped as a hollow cylinder, and both two ends of the fastener 2 are open. The fastener 2 is received in the oil storage component 1, and the oil storage cavity 9 for storing tobacco tar is formed between an outer wall of the fastener 2 and an inner wall of the oil storage component 1. One end of the oil storage cavity 9 away from the nozzle 10 is sealed by the second electrode 6, so that the sealed oil storage cavity 9 for storing tobacco tar is formed inside the oil storage component 1. That is, the oil storage component 1, the fastener 2, and the buckle portion 61 cooperatively form the oil storage cavity 9, and the tobacco tar is stored in the oil storage cavity 9, so that the tobacco tar is prevented from leakage. One side of the oil storage cavity 9 defines an oil outlet 21, and the oil outlet 21 is used to enable the tobacco tar in the oil storage cavity 9 to flow into the heating assembly 4. The fastener 2 is made of metal conducting material, and has conductive function and certain rigidity. In this embodiment, an inner wall of the fastener 2 forms the holding cavity 11, and serves as the cavity wall of the holding cavity 11. Understandably, in other embodiments, the fastener 2 can be made of non-metallic material and integrally formed with the oil storage component 1, and a surface of the fastener 2 is coated with a conducting layer.

The fastener 2 is sheathed outside the supporter 3, one end of the fastener 2 near the second electrode 6 is embedded inside the second electrode 6 and is electrically connected to the second electrode 6. Specifically, one end of the fastener 2 is inserted into and fixed in the groove 611 of the second electrode 6, thereby achieving an electrical connection between the fastener 2 and the second electrode 6. Because the oil storage cavity 9 is formed by the fastener 2 and the oil storage component 1, the side wall of the fastener 2 is just the cavity wall of the oil storage cavity 9. The oil outlet 21 is defined in the sidewall of the fastener 2 near the second electrode 6, so that the tobacco tar in the oil storage cavity 9 can flow into the fastener 2 via the oil outlet 21 and be further transmitted to the heating assembly 4, to be atomized by the heating assembly 4. Understandably, there is no limit to the number and the shape of the oil outlet 21. The number of the oil outlet can be one, two or more, and the shape of the oil outlet 21 can be round, square, cone, and so on. The number and the shape of the oil outlet 21 can be adjusted according to smoke volume requirement of users, so that the needs of different users can be met. In this embodiment, the number of the oil outlet 21 is eight, and the eight oil outlets 21 are defined at intervals.

The supporter 3, the first electrode 5, and the clamp seat 7 are all sleeved inside the hollow fastener 2, and the first electrode 5, the clamp seat 7, and the supporter 3 are successively sleeved in the fastener 2 from inside to outside. The clamp seat 7 is fixed between the supporter 3 and the first electrode 5.

The supporter 3 is substantially a hollow cylinder located between the outer wall of the clamp seat 7 and the inner wall of the fastener 2 and fixedly sheathed on the clamp seat 7. In this embodiment, the supporter 3 defines a mounting hole (not labeled) for mounting the heating assembly 4, and the mounting hole is a through hole radially penetrating the supporter 3.

Figure 6:
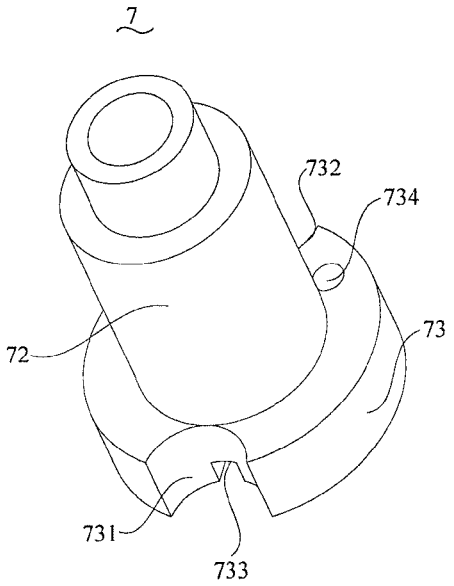
FIG. 6 is a structural schematic view of a clamp seat of the atomizer of the preferred embodiment of the present application.
Figure 7:
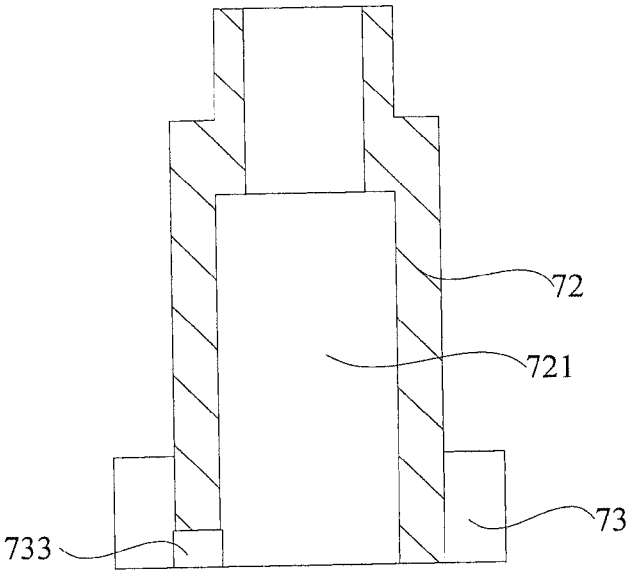
FIG. 7 is a cut-away view of the clamp seat shown in FIG. 6.

As shown in FIG. 6 and FIG. 7, a side surface of the clamp seat 7 defines a first through groove 731 and a second through groove 732 configured to enable the heating assembly 4 to go through, and the heating assembly 4 abuts against the cavity wall of the holding cavity 11, a first groove wall of the first through groove 731, and a second groove wall of the second through groove 732 respectively. The clamp seat 7 is substantially a hollow cylinder, and includes a body 72 and a boss 73. The body 72 is substantially a stepped hollow cylinder, one end of the body 72 near the first electrode 5 defines a connector hole 721, and the first electrode 5 is inserted in the connector hole 721, so that one end of the first electrode 5 is sheathed in the body 72. The boss 73 is substantially a circular ring with an opening, and is formed by increasing a diameter of one end of the body 72 away from the nozzle 10. In this embodiment, the clamp seat 7 is sheathed between the first electrode 5 and the supporter 3, and the first electrode 5 is inserted in the connector hole 721 and fixed inside the body 72. A diameter of the boss 73 is equal to a radial length of the fastener 2, and the boss 73 abuts against the inner wall of the fastener 2, so that the boss 73 is embedded inside the fastener 2, that is, the boss 73 abuts against the cavity wall of the holding cavity 11. Understandably, the boss 73 can also be connected with the fastener 2 by a tight fit. The supporter 3 is sheathed between the fastener 2 and the clamp seat 7, and one end of the supporter 3 abuts against one end surface of the boss 73 near the body 72, so that the supporter 3 is fixed between the inner wall of the fastener 2 and the outer wall of the body 72.

The boss 73 defines a blind hole 734, the first through groove 731, the second through groove 732, and an opening slot 733. The first through groove 731 and the second through groove 732 are formed by partially concaving a side surface of the ring boss 73 inward. The first through groove 731 and the second through groove 732 are symmetrical relative to a central axis of the boss 73, and both the first through groove 731 and the second through groove 732 are through grooves axially penetrating the boss 73. Understandably, the first through groove 731 and the second through groove 732 can be arc-shaped, round, or other irregular shapes. The opening slot 733 is defined in an end surface of the boss 73 away from the body 72, and the opening slot 733 is communicated with the first through groove 731; the blind hole 734 is defined in an end surface of the boss 73 near the body 72, and the blind hole 734 is located near one side of the second through groove 732. The clamp seat 7 can be made of elastic material such as silicon or foam, and the material is not limited here.

Figure 8:
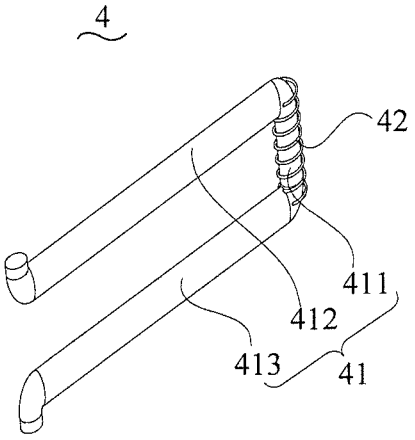
FIG. 8 is a structural schematic view of a heating assembly of the atomizer of the preferred embodiment of the present application.

As shown in FIG. 8, the heating assembly 4 is used to adsorb tobacco tar and atomize the adsorbed tobacco tar to generate smoke for inhalation by users. The heating assembly 4 includes an oil guide rope 41, a heating wire 42, a first electrode connector 43, and a second electrode connector 44. The heating wire 42 winds around the oil guide rope 41 to atomize tobacco tar absorbed by the oil guide rope 41, and the first electrode connector 43 and the second electrode connector 44 are connected with two ends of the heating wire 42 respectively and extend along the two ends of heating wire 42 axially. At least one of the first electrode connector 43 and the second electrode connector 44 is fixed between the electrode assembly and the clamp seat 7 by clamping to form electrical connection with the electrode assembly. Each of the first electrode connector 43 and the second electrode connector 44 has conductive function and can be a wire or an electrode slice, and the shape thereof is not limited here.

In another embodiment, the fastener 2 and the second electrode 6 can be integrally formed, that is, the cylindrical fastener 2 is a part of the second electrode 6. Meanwhile, both the first electrode connector 43 and the second electrode connector 44 are fixed between the electrode assembly and the clamp seat 7 by clamping. In particular, the first electrode connector 43 is fixed between the first electrode 5 and the clamp seat 7 by clamping, and the second electrode connector 44 is fixed between the second electrode 6 and the clamp seat 7 by clamping.

In this embodiment, the first electrode connector 43 is sandwiched between the clamp seat 7 and the first electrode 5 to form electrical connection between the first electrode connector 43 and the first electrode 5, and the second electrode connector 44 is sandwiched between the clamp seat 7 and the fastener 2 to form electrical connection between the second electrode connector 44 and the second electrode 6. According to above connections, specific connection methods are detailed as the following.

The oil guide rope 41 is made of material with liquid adsorption and storage function, such as cotton or fiber, and is used to adsorb and store a certain amount of tobacco tar to be atomized by the heating wire 42. The oil guide rope 41 extends to one side of the clamp seat 7 away from the heating wire 42, and the clamp seat 7 is configured to clamp the oil guide rope 41. In this embodiment, the oil guide rope 41 is substantially U-shaped, and includes a straight segment 411, a first bent segment 412, and a second bent segment 413. The heating wire 42 winds around the straight segment 411, and the straight segment 411 winded by the heating wire 42 runs through the mounting hole defined in the supporter 3 to be mounted on the supporter 3 horizontally. The first bent segment 412 and the second bent segment 413 extend towards the second electrode 6 along an outer sidewall of the supporter 3, and are fixed between the inner wall of the fastener 2 and the outer wall of the clamp seat 7. In this embodiment, a diameter of the first bent segment 412 is greater than a radial width of the first through groove 731, and a diameter of the second bent segment 413 is greater than a radial width of the second through groove 732. When the first bent segment 412 and the second bent segment 413 extend to the boss 73, the first bent segment 412 is squeezed by the first through groove 731 to be fixed inside the first through groove 731, and then the first bent segment 412 continually extends to close the second electrode 6 and fixedly abut against the inner wall of the fastener 2. When the second bent segment 413 extends to the second through groove 732, the second bent segment 413 is squeezed to be fixed inside the second through groove 732, and then the second bent segment 413 continually extends to close the second electrode 6 and fixedly abut against the inner wall of the fastener 2. In the above-mentioned embodiment, the oil guide rope 41 abuts against the cavity wall of the holding cavity 11, a first groove wall of the first through groove 731, and a second groove wall of the second through groove 732 respectively, and thus the clamp seat 7 clamps the oil guide rope 41. By defining the first through groove 731 and the second through groove 732, tobacco tar can be transported to the oil guide rope 41 smoothly, and thus the heating wire 42 can be prevented from being burnt. Furthermore, a circumferential surface of the boss 73 of the clamp seat 7 can be in tight contact with the holding cavity 11, so that tobacco tar is prevented from leaking into an area in the holding cavity 11 where the heating wire 42 is received, and the smokers will not inhale the tobacco tar. Understandably, a shape of the clamp seat 7 is arbitrary: a crack or hole can be independently defined in the clamp seat 7 for clamping the oil guide rope 41; the first through groove 731 and the second through groove 732 can also be omitted, and both the outer wall of the clamp seat 7 and the cavity wall of the holding cavity 11 can directly abut against the oil guide rope 41 to clamp the oil guide rope 41. The clamping method is not limited in the present invention.

As shown in FIG. 3, the first bent segment 412 is squeezed to be fixed between the first groove wall of the first through groove 731 and the cavity wall of the holding cavity 11, the second bent segment 413 is squeezed to be fixed between the second groove wall of the second through groove 732 and the cavity wall of the holding cavity 11, and both the first bent segment 412 and the second bent segment 413 extend to close the second electrode 6. Since the oil outlet 21 is defined in a sidewall of the fastener 2 near the second electrode 6, when tobacco tar flows from the oil storage cavity 9 to the first bent segment 412 and the second bent segment 413 through the oil outlet 21, the tobacco tar can further flow to close the straight segment 411 along axial directions of the first bent segment 412 and the second bent segment 413. When the tobacco tar flows into sections of the first bent segment 412 and the second bent segment 413 that are fixed inside the first through groove 731 and the second through groove 732 respectively, both the first bent segment 412 and the second bent segment 413 are squeezed, and their cross sectional areas are reduced. Thus, the flowing speed of the tobacco tar flowing to the straight segment 411 becomes lower, and the tobacco tar flow decreases. Finally, the tobacco tar in the straight segment 411 winded by the heating wire 42 is less, and the oil guide rope 41 is squeezed and fixedly clamped by the first through groove 731 and the second through groove 732, and thus excessive tobacco tar is prevented from being transported to the heating wire 42. In this way, the amount of the tobacco tar in the heating wire 42 is appropriate and the tobacco tar can be atomized in time, which avoids the case that excessive tobacco tar on the heating wire 42 cannot be atomized in time and may flow into the holding cavity 11 to form oil leakage. The smokers will not inhale the tobacco tar, and the users' experience is improved. Besides, when the electronic cigarette is placed vertically, the tobacco tar in the straight segment 411 can flow back to one side of the clamp seat 7 away from the heating wire 42 via the first bent segment 412 and the second bent segment 413, and thus the tobacco tar is further prevented from flowing into the holding cavity 11.

In this embodiment, the straight segment 411, the first bent segment 412 and the second bent segment 413 are integrally formed. Such a structure has good integration effect and is easy to produce. Since the oil guide rope 41 is integrally formed, a through oil channel is formed in the oil guide rope 41, and the burning phenomenon of the heating wire 42 is avoided.

The first electrode connector 43 and the second electrode connector 44 extend to close the same side of the first electrode 5, and are electrically connected to the battery rod respectively to supply power to the heating wire 42. The first electrode connector 43 is sandwiched between the clamp seat 7 and the first electrode 5 to form the electrical connection between the first electrode connector 43 and the first electrode 5. The second electrode connector 44 is electrically connected to the fastener 2, and the fastener 2 is further electrically connected to the second electrode 6, so that the second electrode connector 44 is electrically connected to the second electrode 6 through the fastener 2.

In this embodiment, the first electrode connector 43 connected with one end of the heating wire 42 extends along an outer sidewall of the supporter 3 axially and runs through the first through groove 731, then the first electrode connector 43 is bent toward the inner wall of the connector hole 721 and is finally sandwiched between the inner wall of the connector hole 721 and the outer wall of the first electrode 5 to form the electrical connection between the first electrode connector 43 and the first electrode 5. Compared with conventional electrical connection methods using welding technology, the first electrode connector 43 is not prone to fall apart, the connection is compact, and the internal structure is simple.

In other embodiment of the present application, the boss 73 defines the opening slot 733 which is communicated with the first through groove 731. The first electrode connector 43 runs through the first through groove 731 and the opening slot 733 successively and extends along the axial direction of the connector hole 721, so that the first electrode connector 43 is sandwiched between the inner wall of the connector hole 721 and the outer wall of the first electrode 5. The opening slot 733 is configured to make the first electrode connector 43 be bent, and the bent part of the first electrode connector 43 is located inside the boss 73, so that the bent part is protected from extrusion or impact by other components, and thus the bent part can be prevented from being damaged. In this way, the service life of the first electrode connector 43 is improved, and smooth transmission of electrical signals is ensured.

The second electrode connector 44 is connected with the other end of the heating wire 42, and does not contact with the first electrode connector 43. The second electrode connector 44 is sandwiched between the cavity wall of the holding cavity 11 and the clamp seat 7 to form the electrical connection between the second electrode connector 44 and the second electrode 6. In this embodiment, one end of the second electrode connector 44 away from the heating wire 42 is bent to be substantially U-shaped. Particularly, the second electrode connector 44 is firstly bent towards one end thereof near the fastener 2 to form a straight line, and then is bent towards a side near the nozzle 10 along the axial direction of the fastener 2 to form a U-shaped distal end of the second electrode connector 44. Since the second bent segment 413 is embedded inside the second through groove 732 and is squeezed and fixed by the sidewall of the fastener 2, the U-shaped distal end of the second electrode connector 44 is sandwiched between the second through groove 732 and the fastener 2, and the second electrode connector 44 is thereby electrically connected to the fastener 2. The second electrode connector 44 is fixed by clamping, compared with conventional methods using welding technology, the clamping method has the advantages of simpler process, easier assembly, and stability connection. Understandably, the shape of the distal end of the second electrode connector 44 is not limited to be U-shaped. The distal end of the second electrode connector 44 can also be bent to be V-shaped, W-shaped, or other irregular shapes, if only the end of the second electrode connector 44 can be sandwiched between the second through groove 732 and the fastener 2 to form fixation of the second electrode connector 44 and electrical connection with the fastener 2.

In other embodiment, an end surface of the boss 73 near the body 72 defines the blind hole 734, and the blind hole 734 is located at one side of the boss 73 near the second through groove 732. One end of the second electrode connector 44 away from the heating wire 42 runs through the blind hole 734 and is bent to extend towards a side away from the boss 73, and is finally sandwiched between the clamp seat 7 and the fastener 2 to form the electrical connection between the second electrode connector 44 and the fastener 2. In this embodiment, the blind hole 734 is configured for the second electrode connector 44 to go through, and can avoid tobacco tar on a side of the clamp seat 7 away from the heating wire 42 flowing into the area where the heating wire 42 is positioned. Thus, oil leakage is avoided.

In conclusion, in the atomizer of the present application, the heating assembly 4, the supporter 3, the first electrode 5, and the clamp seat 7 are all received in the fastener 2. The oil guide rope 41 is fixedly clamped by the fastener 2 so that the oil guide rope 41 is squeezed and fixed inside the fastener 2, which prevents excessive tobacco tar from being transported to the heating wire 42 and avoids oil leakage. Furthermore, the clamp seat 7 is fixedly mounted between the supporter 3 and the first electrode 5, and the first through groove 731 and the second groove 732 are defined in the clamp seat 7. The first electrode connector 43 runs through the first through groove 731 and is then bended, and the first electrode connector 43 is sandwiched between the outer wall of the first electrode 5 and the inner wall of clamp seat 7 to form the electrical connection between the first electrode connector 43 and the first electrode 5. The end of the second electrode connector 44 away from the heating wire 42 is bent to be U-shaped, and the U-shaped second electrode connector 44 is sandwiched between the second through groove 732 and the fastener 2. Thus, the second electrode connector 44 is electrically connected to the fastener 2, and the fastener 2 fixedly abuts against the second electrode 6, so that the second electrode connector 44 is electrically connected to the second electrode 6. That is, the first electrode connector 43 and the second electrode connector 44 are respectively electrically connected to the first electrode 5 and the second electrode 6 by clamping. Compared with the welding method in the prior art, the clamping method for fixing is simple in process, easy to assemble, and more stable in connection, and can improve the working efficiency and easily achieve automatic production.

Furthermore, the fastener 2 is sleeved in the oil storage component 1, the oil storage cavity 9 for storing tobacco tar is formed between the outer wall of the fastener 2 and the inner wall of the oil storage component 1, and the sidewall of the fastener 2 defines at least one oil outlet 21. Thus, tobacco tar in the oil storage cavity 9 can run through the oil outlet 21 and enter the fastener 2, and the tobacco tar can further flow onto the first bent segment 412 and the second bent segment 413 which are squeezed and fixed by the fastener 2. Since both the first bent segment 412 and the second bent segment 413 are squeezed, their cross sectional areas are reduced. Thus, the flowing speed of tobacco tar flowing to the straight segment 411 becomes lower, and the tobacco tar flow decreases. Finally, tobacco tar on the straight segment 411 winded by the heating wire 42 is less. Therefore, using the first through groove 731 and the second through groove 732 to squeeze, clamp, and fix the oil guide rope 41 can prevent excessive tobacco tar from being transported to the heating wire 42. In this way, the amount of the tobacco tar on the heating wire 42 is appropriate and the heating wire 42 can atomize the tobacco tar in time, which avoids the case that excessive tobacco tar on the heating wire 42 cannot be atomized in time and may flow into the atomizer to form oil leakage.

Figure 9:
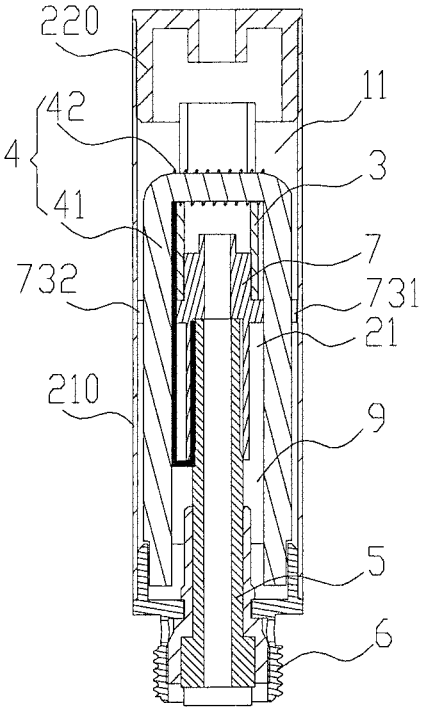
FIG. 9 is a cut-away view of an atomizer of another preferred embodiment of the present application.

FIG. 9 is a cut-away view of an atomizer of another embodiment of the present application, the atomizer comprises an outer sleeve 210, and a nozzle cover 220 and an electrode assembly which are mounted on two ends of the outer sleeve 210 respectively. A holding cavity 11 is formed in the outer sleeve 210. The electrode assembly includes a first electrode 5 and a second electrode 6 electrically insulated from each other, the first electrode 5 extends into the holding cavity 11, an oil storage cavity 9 is formed between an outer wall of the first electrode 5 and an inner wall of the outer sleeve 210, and one end of the oil storage cavity 9 away from the electrode assembly defines an oil outlet 21. Specifically, in this embodiment, the oil outlet 21 is formed between one end of the first electrode 5 extending into the holding cavity 11 and a part of the inner wall of the outer sleeve 210 corresponding to the end of the first electrode 5. Understandably, the oil outlet 21 is defined for describing the position of the clamp seat 7, and there is no limit to the structure and position of the oil outlet 21.

A supporter 3 is received in the holding cavity 11, and a heating assembly 4 is mounted on the supporter 3. The heating assembly 4 includes a heating wire 42 electrically connected to both the first electrode 5 and the second electrode 6, and an oil guide rope 41 for transferring tobacco tar to the heating wire 42. Both two ends of the oil guide rope 41 extend into the oil storage cavity 9. Understandably, in order to store tobacco tar better and avoid oil leakage and transporting excessive tobacco tar, an oil storage cotton for absorbing tobacco tar can be received in the oil storage cavity 9, and there is no limit to this structure.

A clamp seat 7 sheathed outside one end of the first electrode 5 is received in the holding cavity 11 and is located between the heating wire 42 and the oil outlet 21. A side surface of the clamp seat 7 defines a first through groove 731 and a second through groove 732 configured to enable two ends of the oil guide rope 41 to go through respectively, and a circumference of the clamp seat 7 abuts against the inner wall of the outer sleeve 210 to seal tobacco tar. One end of the supporter 3 is sheathed outside the clamp seat 7, the oil guide rope 41 extends to a side of the clamp seat 7 away from the heating wire 42, and the clamp seat 7 clamps the oil guide rope 41 using groove walls of the first through groove 731 and the second through groove 732. In this embodiment, the oil outlet 21 defined in the side of the oil storage cavity 9 is located close to the first through groove 731 and the second through groove 732, and tobacco tar in the oil storage cavity 9 can run through the oil outlet 21 and flow from the oil guide rope 41 to the heating wire 42 to be atomized by the heating wire 42.

In the present application, since the clamp seat 7 is received in the holding cavity 11 and is located between the heating wire 42 and the oil outlet 21, and the oil guide rope 41 is clamped by the clamp seat 7, tobacco tar in the oil guide rope 41 is mainly congregated in an area of one side of the clamp seat 7 away from the heating wire 42. Thus, the amount of the tobacco tar in the heating wire 42 is appropriate and the heating wire 42 can atomize the tobacco tar in time, which avoids the case that excessive tobacco tar in the heating wire 42 cannot be atomized in time and the tobacco tar in the heating wire 42 may flow into the holding cavity 11 to form oil leakage. The smokers will not inhale the tobacco tar, and the smokers' experience is improved.

Figure 10:
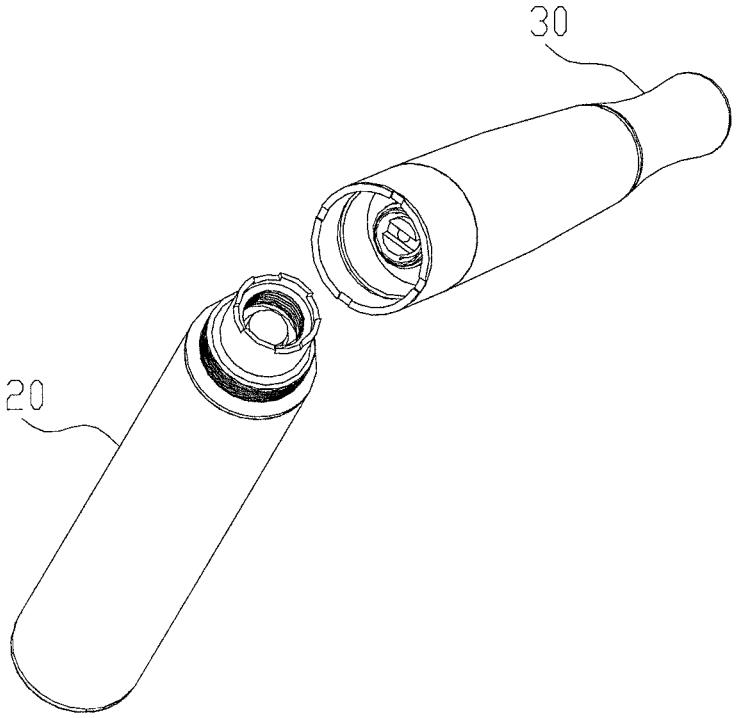
FIG. 10 is a structural schematic view of an electronic cigarette of a preferred embodiment of the present application.

As shown in FIG. 10, the present application further provides an electronic cigarette. The electronic cigarette comprises an atomizer 30 and a battery rod 20 which are interconnected, and the atomizer 30 and the battery rod 20 are detachably or non-detachably connected together to form a whole. The atomizer 30 can be connected with the battery rod 20 by threaded connection, buckle connection, tight fit, integrally forming, magnetic connection, and so on. The atomizer 30 of the present application can be the atomizer of any one of the above-mentioned embodiments. Since the atomizer 30 has the structural characteristics of the above-mentioned atomizer, the electronic cigarette formed by the atomizer 30 can have all advantages of the above-mentioned atomizer. In this embodiment, the atomizer 30 is the atomizer of the first embodiment. The battery rod 20 is a battery rod in the prior art, so it is not detailed here.

In another aspect, the present application further provides a method for assembling an atomizer. The atomizer comprises an oil storage cavity 9 for storing tobacco tar, a holding cavity 11, a heating assembly 4 received in the holding cavity 11, and an electrode assembly configured to be electrically connected with a battery rod. The heating assembly 4 includes a heating wire 42 electrically connected to the electrode assembly and an oil guide rope 41 for transferring tobacco tar to the heating wire 42, one side of the oil storage cavity 9 defines an oil outlet 21, a clamp seat 7 configured to clamp the oil guide rope 41 is received in the holding cavity 11 and located between the heating wire 42 and the oil outlet 21, and the oil guide rope 41 extends to one side of the clamp seat 7 away from the heating wire 42. The assemble method comprises the following steps:

S1: inserting the heating assembly 4, the clamp seat 7, and the electrode assembly into the holding cavity 11;

S2: locating the clamp seat 7 configured to clamp the oil guide rope 41 between the heating wire 42 and the oil outlet 21.

Wherein the electrode assembly includes a first electrode 5 and a second electrode 6 electrically insulated from each other, the atomizer further comprises an oil storage component 1, a fastener 2, and a supporter 3 sleeved in the fastener 2 and configured to fix the heating assembly 4. The first electrode 5, the clamp seat 7, and the supporter 3 are successively sheathed in the fastener 2 from inside to outside. The oil storage component 1 is sheathed outside the fastener 2, and the oil storage cavity 9 for storing tobacco tar is formed between the oil storage component 1 and the fastener 2. An outer wall of the fastener 2 serves as a cavity wall of the oil storage cavity 9. The oil outlet 21 is defined in a sidewall of the fastener 2. The fastener 2 is substantially a hollow cylinder, an inner wall of the fastener 2 forms the holding cavity 11, and the inner wall of the fastener 2 serves as a cavity wall of the holding cavity 11.

The clamp seat 7 includes a body 72 and a round boss 73 formed on one end of the body 72. The first electrode 5 is sheathed in the hollow interior of the clamp seat 7, the boss 73 just abuts against and is fixed on the inner wall of the fastener 2, and the boss 73 defines a first through groove 731 and a second through groove 732.

In assembly of the atomizer, the first electrode 5, the clamp seat 7, and the supporter 3 are successively sheathed in the fastener 2 from inside to outside, the heating assembly 4 is fixed on the supporter 3, and the clamp seat 7 is fixedly sheathed in the first electrode 5. The first electrode connector 43 is sandwiched between the clamp seat 7 and the first electrode 5 to form electrical connection between the first electrode connector 43 and the first electrode 5, and the second electrode connector 44 is sandwiched between the clamp seat 7 and the fastener 2 to form electrical connection between the second electrode connector 44 and the second electrode 6. The oil guide rope 41 is squeezed to be fixed inside the first through groove 731 and the second through groove 732 of the clamp seat 7.

In the method for assembling the atomizer of the present application, the first electrode connector 43 is sandwiched between the clamp seat 7 and the first electrode 5 to form the electrical connection between the first electrode connector 43 and the first electrode 5, and the second electrode connector 44 is sandwiched between the clamp seat 7 and the fastener 2 so that the second electrode connector 44 is electrically connected to the second electrode 6 through the fastener 2. Compared with conventional methods using welding, the fixing method using clamping is simple in process, easy to assemble, and more stable in connection, and can improve the working efficiency and easily achieve automatic production.

In conclusion, by implementing the atomizer, the electronic cigarette using the atomizer, and the method for assembling the atomizer of the present application, the following advantages can be achieved: (1) the first electrode connector and the second electrode connector are respectively electrically connected to the first electrode and the second electrode by the clamping method. Compared with the welding method in the prior art, the clamping method for fixing is simple in process, easy to assemble, and more stable in connection, and can improve the working efficiency and easily achieve automatic production. (2) the oil outlet of the oil storage cavity is defined in an end of the oil storage cavity that is away from the heating wire, and a clamp seat is received in the holding cavity and is located between the heating wire and the oil outlet. The clamp seat is configured to clamp the oil guide rope, so that the tobacco tar inside the oil guide rope is mainly congregated in an area near one side of the clamp seat that is away from the heating wire. In this way, the amount of the tobacco tar on the heating wire is appropriate and the heating wire can atomize the tobacco tar in time, which avoids the case that excessive tobacco tar on the heating wire cannot be atomized in time and may flow into the holding cavity to form oil leakage. The smokers will not inhale the tobacco tar, and thus the users' experience is improved. (3) the oil guide rope is integrally formed and forms a through oil channel, which is convenient to tobacco tar circulation.

The present application has been described with the drawings to the embodiments, while the present application is not limit to the aforementioned specific embodiments and the specific embodiments are merely a hint rather than a limit. It will be understood by those skilled in the art that various changes may be made and equivalents may be substituted without departing from the purpose of the application and the scope of the claims, but all the changes will be included within the scope of the appended claims.

The invention claimed is:

1. An atomizer configured to be connected to a battery rod to form an electronic cigarette, comprising: an oil storage cavity, a holding cavity, a heating assembly received in the holding cavity, and an electrode assembly configured to be electrically connected to the battery rod; the heating assembly including a heating wire electrically connected to the electrode assembly and an oil guide rope for transferring oil to the heating wire; wherein one side of the oil storage cavity defines an oil outlet, a clamp seat configured to clamp the oil guide rope, received in the holding cavity, and located between the heating wire and the oil outlet, and the oil guide rope extends to one side of the clamp seat away from the heating wire;

wherein a side surface of the clamp seat defines a first through groove and a second through groove configured to enable two ends of the oil guide rope to go through respectively, and the oil guide rope abuts against a cavity wall of the holding cavity, a first groove wall of the first through groove, and a second groove wall of the second through groove respectively;

wherein the heating assembly further includes a first electrode connector and a second electrode connector connected with two ends of the heating wire respectively and both electrically connected to the electrode assembly, the clamp seat is fixed on the electrode assembly, and at least one of the first electrode connector and the second electrode connector is fixed between the electrode assembly and the clamp seat by clamping;

wherein the electrode assembly includes a first electrode and a second electrode electrically insulated from each other, the first electrode extends into the holding cavity, the clamp seat is sheathed on one end of the first electrode, one end of the first electrode connector away from the heating wire is sandwiched between the clamp seat and the first electrode to form an electrical connection between the first electrode connector and the first electrode;

wherein a supporter is sheathed outside the clamp seat, the supporter defines a radially penetrated mounting hole, and the heating wire runs through the mounting hole to be fixed on the supporter;

wherein the clamp seat includes a hollow cylindrical body and a boss formed by increasing a diameter of one end of the body, one end of the body near the first electrode defines a connector hole, one end of the first electrode is inserted in the connector hole, the boss abuts against the cavity wall of the holding cavity, the oil guide rope is sandwiched between the boss and the cavity wall of the holding cavity, and one end of the supporter abuts against one end surface of the boss;

wherein the cavity wall of the holding cavity is made of conducting material and is electrically connected to the second electrode, and the second electrode connector is sandwiched between the cavity wall of the holding cavity and the clamp seat to form an electrical connection with the second electrode; and wherein the atomizer further comprises a fastener sheathed outside the supporter and electrically connected to the second electrode, the fastener is hollow and cylindrical, an inner wall of the fastener forms the holding cavity and serves as the cavity wall of the holding cavity and the first electrode, the clamp seat and the supporter are successively sheathed in the fastener from inside to outside.

2. The atomizer according to claim 1, wherein the first through groove and the second through groove are defined in the boss and are symmetrical relative to a central axis of the boss, and the first electrode connector extends along a lateral wall of the supporter axially, runs through the first through groove, is bent inward the connector hole, and is sandwiched between an inner wall of the connector hole and an outer wall of the first electrode.

3. The atomizer according to claim 2, wherein an end surface of the boss away from the body defines an opening slot communicating with the first through groove, and the first electrode connector runs through the first through groove and the opening slot successively, extends along the inner wall of the connector hole axially, and is sandwiched between the inner wall of the connector hole and the outer wall of the first electrode.

4. The atomizer according to claim 2, wherein one end of the second electrode connector away from the heating wire is bent to be U-shaped, and is sandwiched between the second through groove and the fastener.

5. The atomizer according to claim 2, wherein the end surface of the boss defines a blind hole, the blind hole is located on one side of the boss near the second through groove, one end of the second electrode connector away from the heating wire runs through the blind hole and is bent to be sandwiched between the clamp seat and the fastener.

6. The atomizer according to claim 2, wherein the oil guide rope is U-shaped, the oil guide rope includes a straight segment configured to be winded by the heating wire, and a first bent segment and a second bent segment formed on two ends of the straight segment respectively and extending toward the same side; and the first bent segment and the second bent segment are squeezed to be fixed inside the first through groove and the second through groove respectively.

7. The atomizer according to claim 1, wherein the atomizer further comprises an oil storage component sheathed outside the fastener, the oil storage cavity is formed between an inner wall of the oil storage component and an outer wall of the fastener, the second electrode is embedded inside one end of the oil storage component away from the heating wire to seal the oil storage cavity, and the fastener is inserted in the second electrode and is electrically connected to the second electrode.

8. The atomizer according to claim 7, wherein the oil outlet is defined in aside wall of the fastener near the second electrode, and oil in the oil storage cavity flows onto the oil guide rope via the oil outlet.

9. An electronic cigarette comprising an atomizer of claim 1 and a battery rod, wherein the atomizer and the battery rod are interconnected.

* * * * *